US012329274B2

(12) United States Patent
Edwards

(10) Patent No.: US 12,329,274 B2
(45) Date of Patent: Jun. 17, 2025

(54) FOLDING TABLE AND METHOD OF MAKING AND USING THE SAME

(71) Applicant: Adam Edwards, Nashville, TN (US)

(72) Inventor: Adam Edwards, Nashville, TN (US)

( * ) Notice: Subject to any disclaimer, the term of this patent is extended or adjusted under 35 U.S.C. 154(b) by 176 days.

(21) Appl. No.: 18/148,770

(22) Filed: Dec. 30, 2022

(65) Prior Publication Data

US 2024/0215711 A1 Jul. 4, 2024

(51) Int. Cl.
*A47B 3/00* (2006.01)
*A47B 3/087* (2006.01)

(52) U.S. Cl.
CPC ..... *A47B 3/087* (2013.01)

(58) Field of Classification Search
CPC ..... A47B 3/087; A47B 2003/025; A47B 2003/0806
USPC ..... 108/166–175, 115
See application file for complete search history.

(56) References Cited

U.S. PATENT DOCUMENTS

| | | | | | |
|---|---|---|---|---|---|
| 587,518 | A | | 8/1897 | Bartelle | |
| 900,552 | A | * | 10/1908 | Kade | |
| 1,210,983 | A | | 1/1917 | Porrazzo | |
| 1,274,973 | A | | 8/1918 | Allen | |
| 1,827,373 | A | | 10/1931 | Rosen | |
| 1,890,710 | A | | 12/1932 | Williams | |
| 2,326,461 | A | | 8/1943 | Howe | |
| 2,587,010 | A | | 2/1952 | Thompson | |
| 2,607,647 | A | | 8/1952 | Howe | |
| 2,695,829 | A | | 11/1954 | Martinez | |
| 2,799,544 | A | | 7/1957 | Hoppe | |
| 2,890,089 | A | * | 6/1959 | Oscoz Sanchez | A47B 3/083 108/115 |
| 2,936,896 | A | * | 5/1960 | Friedman | A47B 3/02 108/1 |
| 2,957,588 | A | * | 10/1960 | Muller | A47B 31/04 108/171 |
| 3,182,615 | A | | 5/1965 | Mees | |
| 3,646,895 | A | | 3/1972 | Campbell | |
| 6,058,853 | A | | 5/2000 | Pinch | |
| 6,076,472 | A | | 6/2000 | Lloyd | |
| 7,475,641 | B2 | | 1/2009 | Jin | |
| 8,196,529 | B2 | | 6/2012 | Witkowski | |
| 2009/0000522 | A1 | * | 1/2009 | Collins | B25H 1/04 108/115 |
| 2022/0015535 | A1 | | 1/2022 | Flynn | |

* cited by examiner

*Primary Examiner* — Janet M Wilkens
(74) *Attorney, Agent, or Firm* — Abel Schillinger, LLP

(57) ABSTRACT

A folding table including a plurality of panel halves that forms a support surface in an open position; a plurality of table leg portions; and an actuating system including: a plurality of bar linkages, each bar linkage operably coupling a table leg portion of the plurality of table leg portions to a corresponding panel half of the plurality of panel halves, at least one handle adapted to actuate the plurality of bar linkages to move the folding table from the open position to a closed position, where the plurality of panel halves fold inwards and downwards toward each other to form the closed position.

19 Claims, 10 Drawing Sheets

FOLDING TABLE AND METHOD OF MAKING AND USING THE SAME

FIELD OF THE DISCLOSURE

The invention generally relates to folding tables and more specifically, folding tables adapted to be collapsible between open and closed positions and methods of making and using the same.

BACKGROUND

Folding tables are commonly known in the art as storable tables. Commonly, a folding table includes folding parts or sections that can move between an open position, where the folding sections are aligned in horizontal relation to form a table surface, to a closed position, where the folding parts or sections are folded together. However, there continues to be a need in the art for a light-weight folding table that is easy to carry and includes mechanisms for easier movement between open and closed positions.

SUMMARY OF THE INVENTION

Embodiments of the invention herein may include a folding table including a plurality of panel halves that form a support surface in an open position; a plurality of table leg portions; and an actuating system including: a plurality of bar linkages, each bar linkage operably coupling a table leg portion of the plurality of table leg portions to a corresponding panel half of the plurality of panel halves, at least one handle adapted to actuate the plurality of bar linkages to move the folding table from the open position to a closed position, where the plurality of panel halves fold inwards and downwards toward each other to form the closed position.

Embodiments of the invention herein may include a method including providing a folding table including: a plurality of panel halves, a plurality of table leg portions, and an actuating system including: a plurality of bar linkages, each bar linkage operably coupling a table leg portion of the plurality of table leg portions to a corresponding panel half of the plurality of panel halves, and at least one handle; and actuating the handle to actuate the bar linkages to move the folding table from an open position to a closed position by folding the plurality of panel haves inwards and downwards toward each other to form the closed position.

BRIEF DESCRIPTION OF THE DRAWINGS

So that the manner in which the features and advantages are attained and can be understood in more detail, a more thorough description may be had by reference to the embodiments that are illustrated in the appended drawings. However, the drawings illustrate only some embodiments and therefore are not to be considered limiting of the scope.

The use of the same reference symbols in different drawings indicates similar or identical items.

DETAILED DESCRIPTION OF THE INVENTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item. Also, the use of "about" or "substantially" is employed to convey spatial or numerical relationships that describe any value or relationship that does not depart from the scope of the invention.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the folding table arts.

Figure 1:
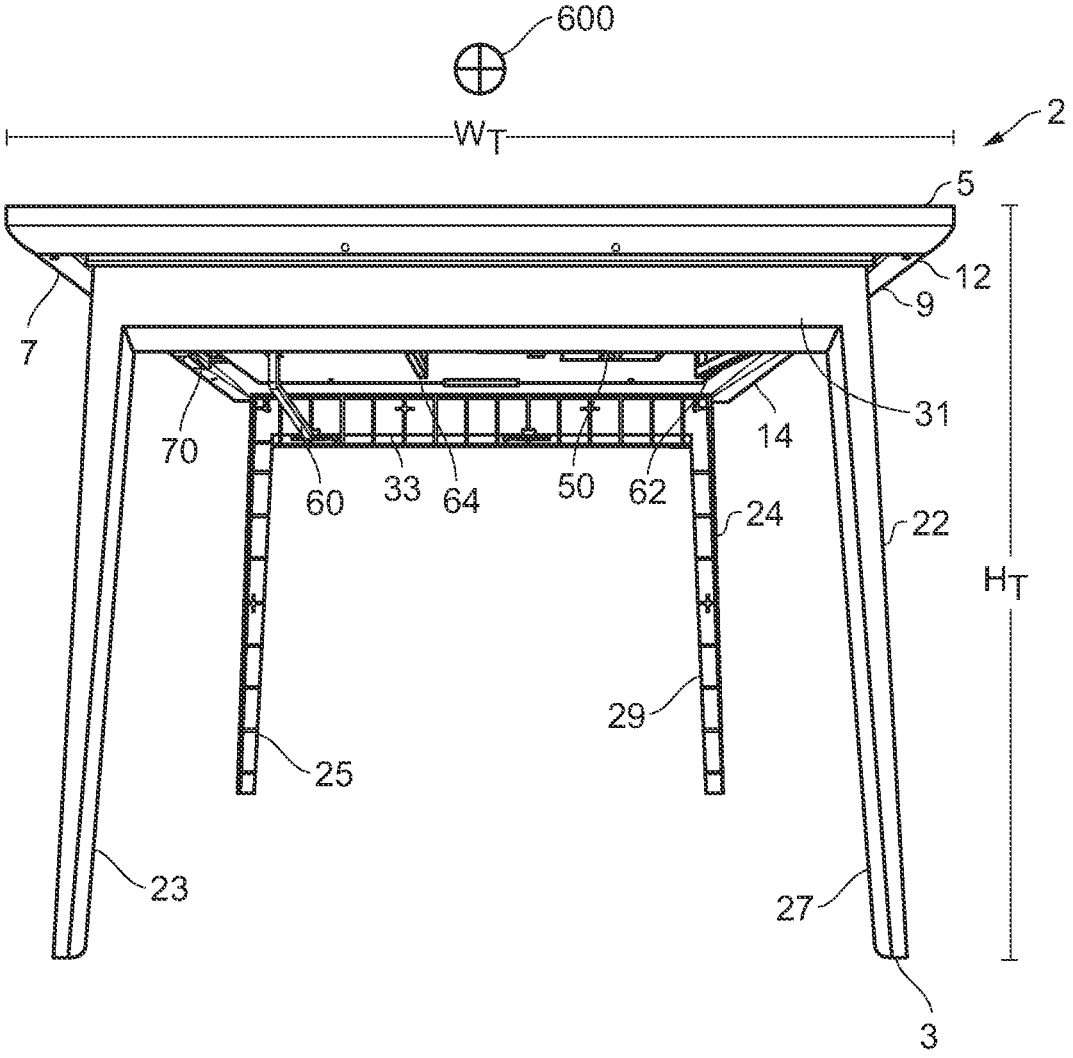
FIG. 1 is an end view with a cut-away of a number of embodiments of a folding table in an open position and constructed in accordance with the invention.
Figure 2:
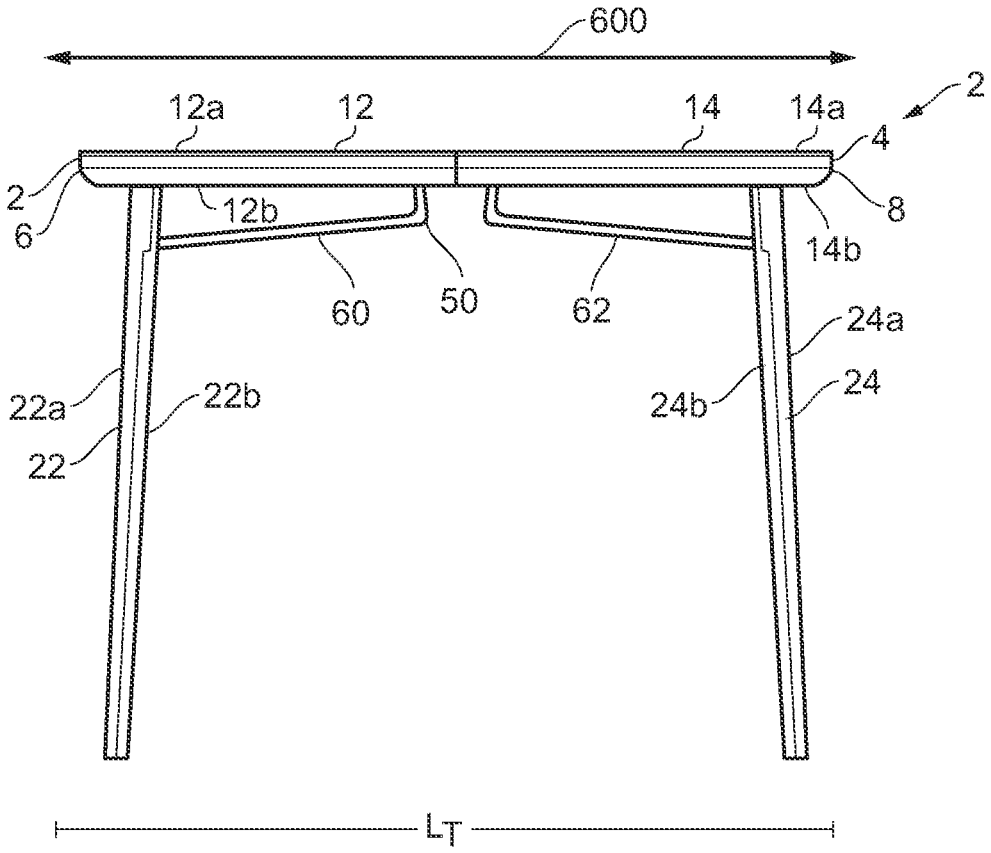
FIG. 2 is a side view of a number of embodiments of a folding table in an open position and constructed in accordance with the invention.
Figure 3:
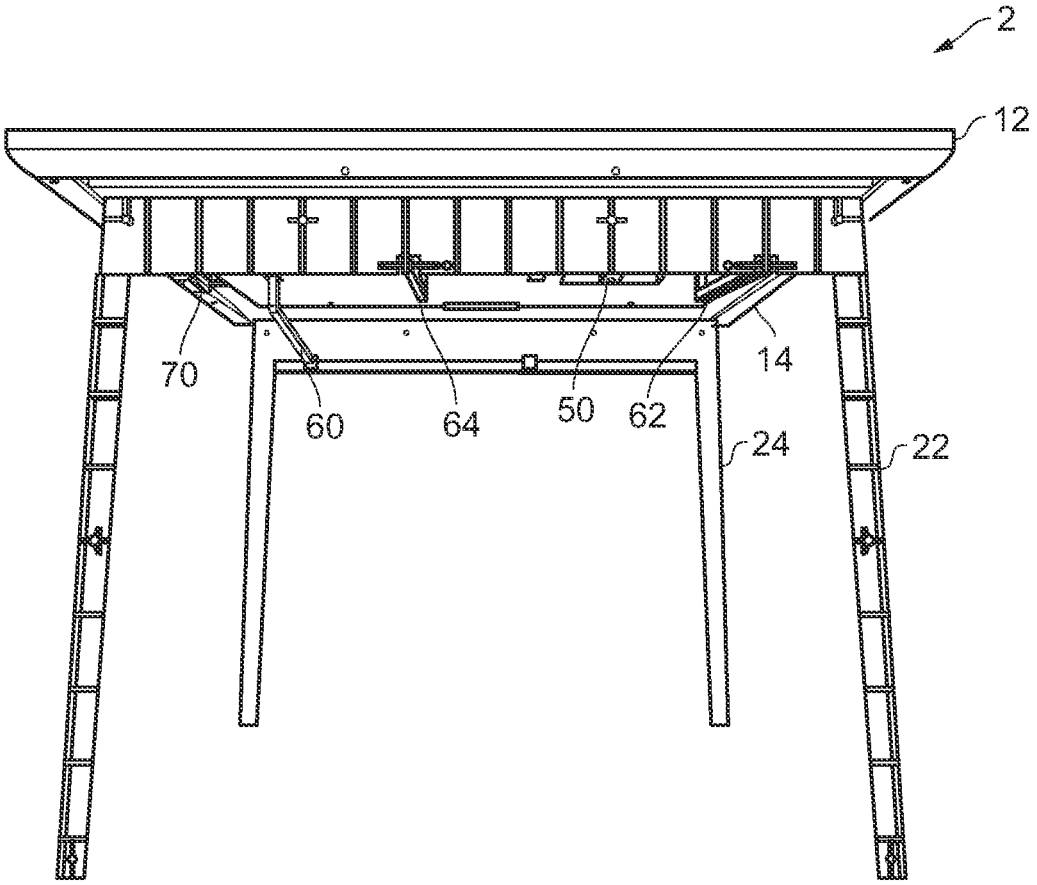
FIG. 3 is an end view of a number of embodiments of a folding table in an open position and constructed in accordance with the invention.

FIGS. 1-3 depict end and side views of a number of embodiments of a folding table in an open position and constructed in accordance with the invention. All similarly operating components of the folding table are labeled with reference numerals that are consistent throughout the Figures. Any labeled component may be expected to operate in a substantially similar manner and have substantially similar structure across all Figures unless specifically defined herein. The folding table 2 may be oriented down an axis 600 may define x (latitudinal, i.e. length), y (longitudinal, i.e. width), and z (vertical, i.e. height) directions. In a number of embodiments, the folding table 2 may be collapsible. In a number of embodiments, the folding table 2 may include components that may be assembled into a fully-formed folding table. In a number of embodiments, the folding table 2 may include a plurality of panel halves 12, 14 as components. The folding table 2 may form an open position defined as a position where the plurality of panel halves 12, 14, form a combined support surface (e.g. table surface). The folding table 2 may form a closed position defined as a position where the plurality of panel halves 12, 14 do not form a combined support surface. In a number of embodiments, the folding table 2 may further include a plurality of table leg portions 22, 24. The table leg portions 22, 24 may support the panel halves 12, 14 in a closed position. In a number of embodiments, the folding table 2 may include an actuating system 50. The actuating system 50 may include a plurality of bar linkages 60, 62, 64, each bar linkage 60, 62, 64, operably coupling a table leg portion 22, 24 of the plurality of table leg portions 22, 24 to a corresponding panel half 12, 14 of the plurality of panel halves 12, 14. The actuating system 50 may further include at least one handle 70 adapted to actuate the plurality of bar linkages 60, 62, 64 to move the folding table 2 from the open position to a closed position, where the plurality of panel halves 12, 14 fold inwards and downwards toward each other to form the closed position.

In a number of embodiments, as shown best in FIG. 2, the folding table 2 may have a length $L_T$ as measured between a first latitudinal end 6 and a second latitudinal end 8 in an open position. The folding table 2 may have a length $L_T$ of at least 12 in., at least 24 in., at least 30 in., at least 36 in., at least 40 in., at least 50 in., at least 60 in., at least 70 in., at least 80 in., at least 90 in., or at least 100 in. The folding table 2 may have a length $L_T$ that may be no greater than 150 in., no greater than 140 in., no greater than 130 in., no greater than 120 in., no greater than 110 in., or no greater than 105 in. It will be further appreciated that the folding table 2 may have a length $L_T$ that may be any value between any of the minimum and maximum values noted above. It can also be appreciated that the folding table 2 may have a length $L_T$ that may be smaller in a closed position than in an open position. In a more specific embodiment, the folding table 2 may have a length $L_T$ in a range of between about 12 in. to about 150 in.

In a number of embodiments, as shown best in FIG. 1, the folding table 2 may have a width $W_T$ as measured between a first longitudinal side 7 and a second longitudinal side 9. The folding table 2 may have a width $W_T$ of at least 12 in., at least 24 in., at least 30 in., at least 36 in., at least 40 in., at least 50 in., at least 60 in., at least 70 in., at least 80 in., at least 90 in., or at least 100 in. The folding table 2 may have a width $W_T$ that may be no greater than no greater than 150 in., no greater than 140 in., no greater than 130 in., no greater than 120 in., no greater than 110 in., or no greater than 105 in. It will be further appreciated that the folding table 2 may have a width $W_T$ that may be any value between any of the minimum and maximum values noted above. In a more specific embodiment, the folding table 2 may have a width $W_T$ in a range of between about 12 in. to about 150 in.

In a number of embodiments, as shown best in FIG. 1, the folding table 2 may have a height $H_T$ as measured between its first vertical side 3 and its second vertical side 5. The folding table 2 may have a height $H_T$ of at least 12 in., at least 24 in., at least 30 in., at least 36 in., at least 40 in., at least 50 in., at least 60 in., at least 70 in., at least 80 in., at least 90 in., or at least 100 in. The folding table 2 may have a height $H_T$ that may be no greater than 150 in., no greater than 140 in., no greater than 130 in., no greater than 120 in., no greater than 110 in., or no greater than 105 in. It will be further appreciated that the folding table 2 may have a height $H_T$ that may be any value between any of the minimum and maximum values noted above. In a more specific embodiment, the folding table 2 may have a height $H_C$ in a range of between about 12 in. and 108 in.

In a number of embodiments, the folding table 2 may have a weight of at least 1 lb., at least 2 lbs., at least 5 lbs., at least 10 lbs., at least 15 lbs., at least 20 lbs., at least 25 lbs., or at least 30 lbs. The folding table may have a weight that may be no greater than 100 lbs., no greater than 75 lbs., no greater than 50 lbs., or no greater than 25 lbs. It will be further appreciated that the folding table 2 may have a weight that may be any value between any of the minimum and maximum values noted above. In a more specific embodiment, the folding table 2 may have a weight a range of between about 1 lb and 50 lbs.

In a number of embodiments, the folding table 2 or any of its components listed herein can comprise a material with sufficient rigidity to withstand axial and longitudinal forces. In a particular embodiment, the folding table 2 or any of its components listed herein may include wood including but not limited to cedar, fir, pine, birch, redwood, ash, cherry, mahogany, maple, oak, poplar, teak, walnut, bamboo, rattan, cotton, wool, straw, hemp, cork, plant-based polyurethane, mycelium, newspaper wood, spruce, Douglas fir, angiosperm, Philippine mahogany, rosewood, plywood, particle board, cardboard, bioplastic, rubber, concrete, combinations thereof, or may be another type. In a more particular embodiment, the folding table 2 or any of its components listed herein may be entirely wood. The folding table 2 or any of its components listed herein may be formed through a woodworking process including, but not limited to, wood carving, joinery, sawing, carpentry, woodturning, or may be another type. The folding table 2 or any of its components listed herein can be finished through at least one of sanding, filing, scraping, bleaching, staining, varnishing, weathering, fuming, or may be finished a different way to provide a more aesthetic appearance. The folding table 2 or any of its components listed herein may include a metal including but not limited to aluminum, zinc, copper, magnesium, tin, platinum, titanium, tungsten, iron, bronze, steel, energizer steel, stainless steel, spring steel, ferrous alloy, non-ferrous alloy, nickel, Eligloy, Inconel, Hastelloy, a metal alloy (including the metals listed), an anodized metal (including the metals listed) or any combination thereof. The folding table 2 or any of its components listed herein may be formed through a metal working process including, but not limited to, machining, welding, milling, threading, grinding, brazing, soldering, riveting, mechanical fixing, heat treating, plating, or may be another type. The folding table 2 or any of its components listed herein may include a polymer including but not limited to a polyketone, a polyaramid, a polyimide, a polyetherimide, a polyphenylene sulfide, a polyetherslfone, a polysulfone, a polypheylene sulfone, a polyamideimide, polyethylene, a fluoropolymer, a polyamide, a polytetrafluoroethylene, a polybenzimidazole, polyether ketone, a polyacetal, polybutylene terephthalate, polyethylene terephthalate, polyethylene, polyphenylene oxide, polyurethane, polyester, liquid crystal polymer (LCP), an acrylic, polycarbonate, polyether sulfone, polyoxymethylene, polyether ether ketone, polyethylene, polyphenylene oxide, polypropylene, polystyrene, polyvinyl chloride, a derivation thereof, or any combination thereof. The folding table 2 or any of its components listed herein may be formed through a polymer working process including, but not limited to, 3-D printing, injection molding, compression molding, calendaring, extrusion, or may be another type.

As stated above, the table 2 may include a plurality of panel halves 12, 14. In a number of embodiments, as shown best in FIG. 2, at least one of the plurality of panel halves 12, 14 may be rectilinear and/or arcuate taken in cross-section with a line perpendicular to the axis 600. In a number of embodiments, at least one of the panel halves 12, 14 may be polygonal. In a number of embodiments, at least one of the panel halves 12, 14 may be rectangular or square in cross-section. In a number of embodiments, at least one of the panel halves 12, 14 may include rectilinear and arcuate portions. In a number of embodiments, at least one of the plurality of panel halves 12, 14 may be an injection molded polymer with a top surface 12*a*, 14*a* forming the support surface and a bottom surface 12*b*, 14*b* with at least a part of the actuating system 50 housed therebetween. In a number of embodiments, at least one of the plurality of panel halves 12, 14 may individually be formed by a single piece or a plurality of pieces, creating a cavity for housing at least a part of the actuating system 50 therein. In a particular embodiment, at least one of the plurality of panel halves 12, 14 may individually be formed by a plurality of pieces formed from a moldable polymer including at least one of the polymers listed above.

As stated above, the table 2 may include a plurality of leg table portions 22, 24. In a number of embodiments, as shown best in FIG. 2, at least one of the plurality of table leg portions 22, 24 may be rectilinear and/or arcuate taken in cross-section with a line perpendicular to the axis 600. In a number of embodiments, at least one of the table leg portions 22, 24 may be polygonal. In a number of embodiments, at least one of the table leg portions 22, 24 may be rectangular or square in cross-section. In a number of embodiments, at least one of the table leg portions 22, 24 may include rectilinear and arcuate portions. In a number of embodiments, at least one of the plurality of table leg portions 22, 24 may be an injection molded polymer with an outer surface 22*a*, 24*a* forming the support surface and an inner surface 22*b*, 24*b* with at least a part of the actuating system 50 housed therebetween. In a number of embodiments, at least one of the plurality of table leg portions 22, 24 may individually be formed by a single piece or a plurality of pieces, creating a cavity for housing at least a part of the actuating system 50 therein. In a particular embodiment as shown in FIGS. 1 and 3, at least one of the plurality of table leg portions 22, 24 may individually be formed by a plurality of pieces formed from a moldable polymer including at least one of the polymers listed above. For example, as shown in FIG. 1, an internal piece on the second table leg portion 24 has been removed to show a panel of the second table leg portion 24. Alternatively, as shown in FIG. 3, an external piece on the first table leg portion 22 has been removed to show a panel of the first table leg portion 22. Referring back to FIG. 1, in a number of embodiments, at least one of the plurality of table leg portions 22, 24 may include a first leg 23, 25, a second leg 27, 29, and an intermediate portion 31, 33. The intermediate portion 31, 33 may connect the first leg 23, 25, to the second leg 27, 29 in each of the plurality of table leg portions 22, 24. The first and second leg portions 23, 25, 27, 29 in each of the plurality of table leg portions 22, 24 may support the folding table 2 by contacting a neighboring surface in an open position.

Figure 4:
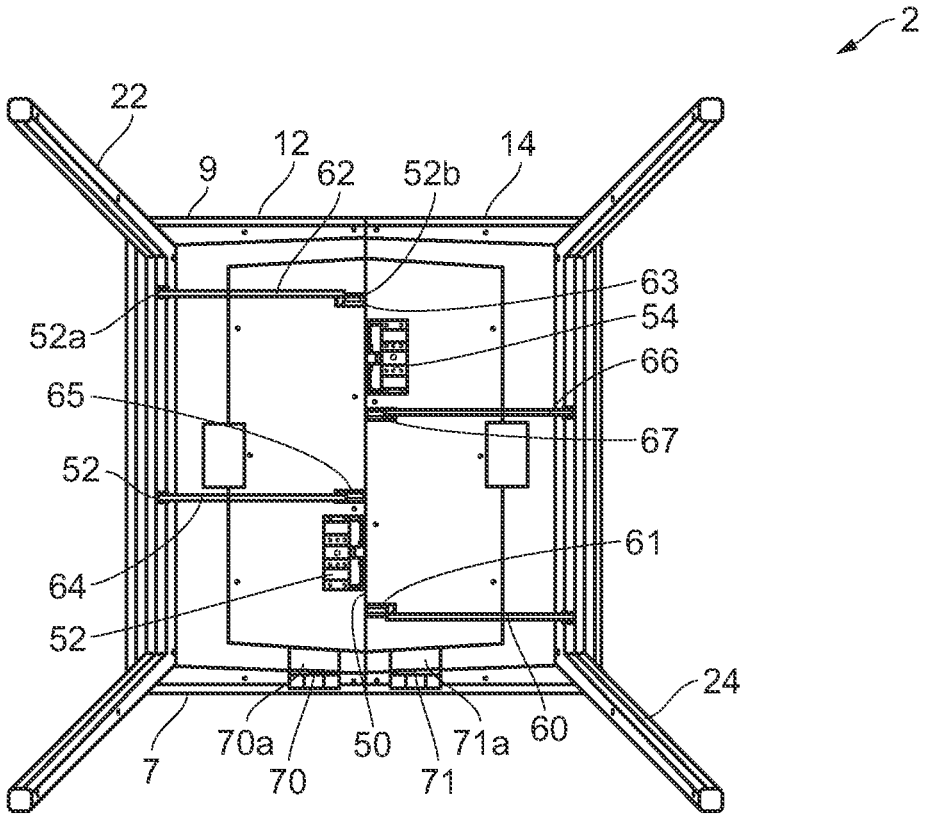
FIG. 4 is a bottom view of a number of embodiments of a folding table in an open position and constructed in accordance with the invention.
Figure 5:
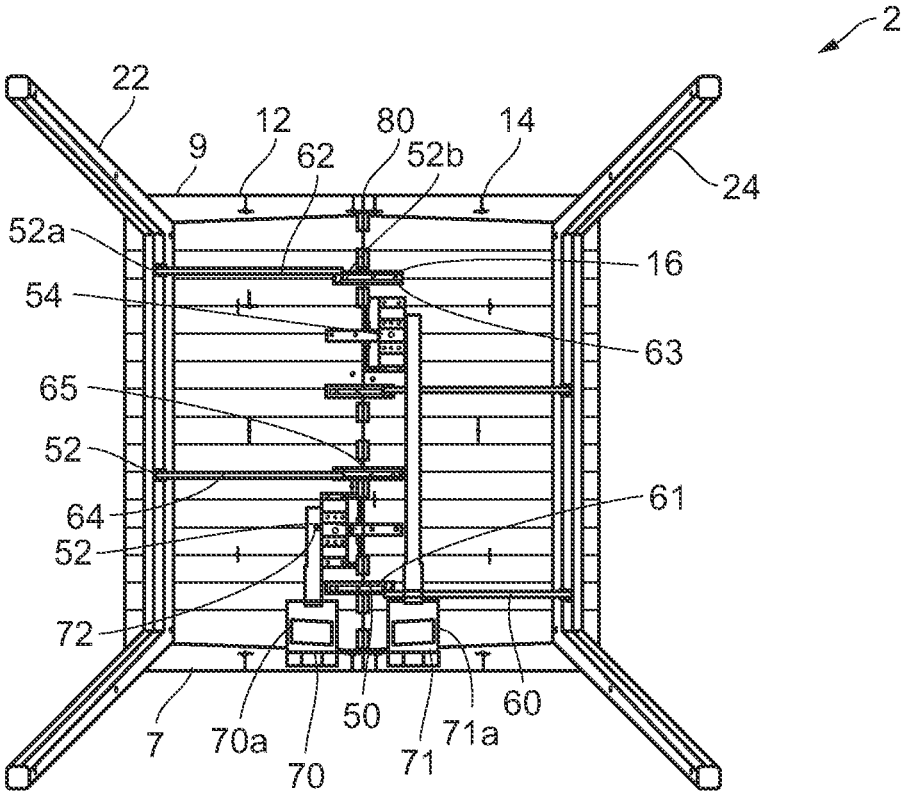
FIG. 5 is a bottom cut-away view of a number of embodiments of a folding table in an open position and constructed in accordance with the invention.
Figure 6:
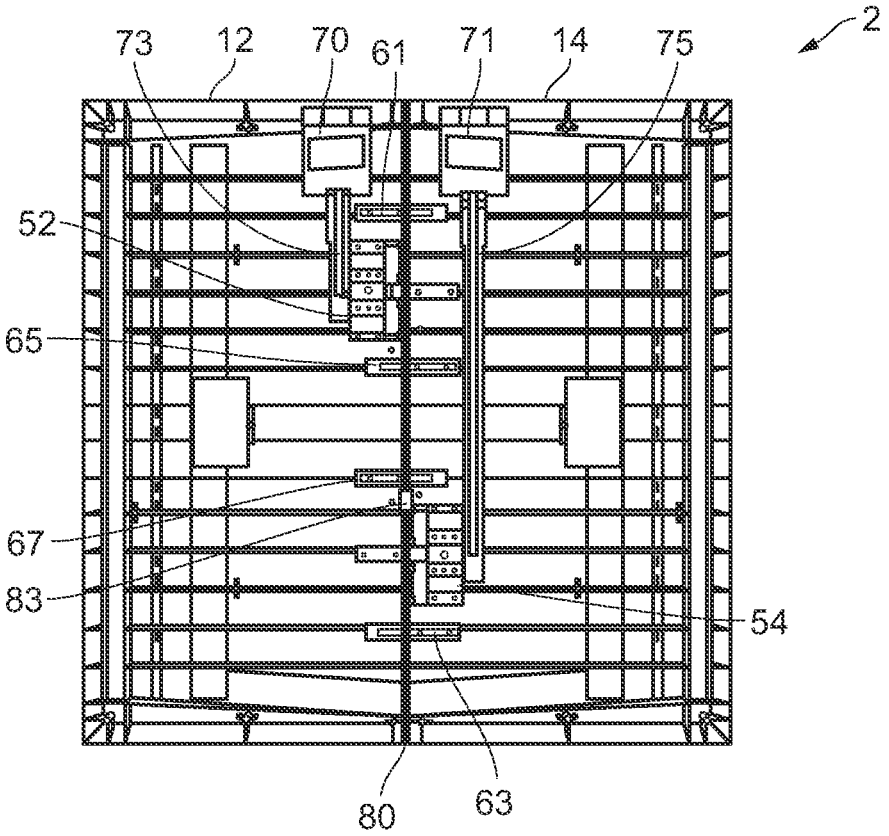
FIG. 6 is a bottom cut-away view of a number of embodiments of a folding table in an open position and constructed in accordance with the invention.

As stated above, the table 2 may include an actuating system 50. FIGS. 4-6 depict a bottom and bottom cut-away views of a number of embodiments of a folding table in an open position and constructed in accordance with the invention. In a number of embodiments, the actuating system 50 may include a plurality of bar linkages 60, 62, 64, 66. In a number of embodiments at least one of the plurality of bar linkages 60, 62, 64, 66 may be L-shaped. In a number of embodiments at least one of the plurality of bar linkages 60, 62, 64, 66 may be formed from at least one metal or polymer including those listed above. In a number of embodiments at least one of the plurality of bar linkages 60, 62, 64, 66 may operably couple a table leg portion 22, 24, of the plurality of table leg portions 22, 24, to a corresponding panel half 12, 14 of the plurality of panel halves 12, 14. The operative coupling may be done through a connection including by welding, adhesive, fasteners, threading, or any other suitable fastening means. In a number of embodiments, as shown in FIGS. 4-6, the operative coupling may be done through a mechanical connection 52. The mechanical connection 52 may include a mechanical linkage by way of at least one fastener. The fastener may include nuts, bolts, bearings, battens, buckles, clips, flanges, frogs, grommets, hook-and-eyes, latches, pegs, nails, rivets, tongue-and grooves, screw anchors, snap fasteners, stitches, threaded fasteners, ties, toggle bolts, wedges anchors, screws, bolts, clamps, clasps, clips, latches, pins, rivets, ties, nails, or may be another type. As shown in FIGS. 4-6, at least one of the plurality of bar linkages 60, 62, 64, 66 may be mechanically coupled to a table leg portion 22, 24 through a first mechanical connection 52*a* and coupled to a panel half 12, 14 through a second mechanical connection 52*b*. In a number of embodiments, at least one of the plurality of bar linkages 60, 62, 64, 66 may include a bar linkage connection 61, 63, 65, 67. In a particular embodiment as shown in FIGS. 4-6, at least one of the plurality of bar linkages 60, 62, 64, 66 may individually be formed by a single piece or a plurality of pieces formed from a moldable polymer including at least one of the polymers listed above. In a number of embodiments, at least one of the plurality of bar linkage connections 61, 63, 65, 67 may couple at least one of the plurality of bar linkages 60, 62, 64, 66 to at least one of the panel halves 12, 14. In a number of embodiments, at least one of the plurality of bar linkage connections 61, 63, 65, 67 may couple at least one of the plurality of bar linkages 60, 62, 64, 66 to at least one of the panel halves 12, 14 through at least one fastener including those listed above. In other words, a fastener may couple at least one of the bar linkages 60, 62, 64, 66 to the bar linkage connections 61, 63, 65, 67 and a fastener may couple at least one of the bar linkage connections 61, 63, 65, 67 to at least one of the panel halves 12, 14 at the second mechanical connection 52*b*. In a number of embodiments, at least one of the plurality of panel halves 12, 14 may include at least one cavity 16 adapted to house the bar linkage connection 61, 63, 65, 67 when the folding table 2 moves to a closed position. [

In a number of embodiments, the actuating system 50 may further include at least one handle 70. In a number of embodiments, the actuating system 50 may further include a plurality of handles 70, 71. In a number of embodiments, at least one of the plurality of handles 70, 71 may be an injection molded polymer with an outer surface 70*a*, 71*a* meant to allow a user to engage the actuating system 50 to move the table from an open position to a closed position or vice versa. In a number of embodiments, at least one of the plurality of handles 70, 71 may be operatively coupled or connected to at least one of the bar linkages 60, 62, 64, 66 to move the table from an open position to a closed position or vice versa. In a number of embodiments, at least one of the plurality of handles 70, 71 may be located on a longitudinal side of one of the panel halves 12, 14.

Referring now to FIG. 6, in a number of embodiments, the actuating system 50 may further include a coupling component 80 that couples the plurality of table halves 12, 14 together to provide a means for folding the folding table 2 from a closed position to an open position and vice versa. In a number of embodiments the coupling component 80 may be formed from at least one metal or polymer including those listed above. In a number of embodiments, the coupling component 80 may include a hinged connection coupling the plurality of panel halves 12, 14 together. In a number of embodiments, the coupling component 80 may include an axle rod coupling the plurality of panel halves 12, 14 together. In an embodiment, the axle rod may rotate the panel halves 12, 14 relative to one another during transition between an open position and a closed position or vice versa. In a number of embodiments, as shown in FIG. 6, the coupling component 80 may include at least one butler hinge 83 that couples the table halves 12, 14 together to provide a pivot joint therebetween. The pivot joint may include a butt joint, an overlap joint, a bridle joint, a dowel joint, a mitre joint, a finger joint, a dovetail joint, a dado joint, a groove joint, a tongue and groove joint, a mortise and tenon joint, a birdsmouth joint, a cross lap joint, a splice joint, a biscuit joint, a pocket-hole joint, a biscuit joint, a floating tenon joint, a stitch and glue joint, a domino joiner, a living hinge, or may be another type. In an embodiment, the butler hinge 83 may rotate the panel halves 12, 14 relative to one another during transition between an open position and a closed position or vice versa.

Referring now to FIGS. 4-6, in a number of embodiments, the actuating system 50 may further include at least one actuator 52, 54. The actuator 52, 54 may provide force to move the folding table 2 from an open position to a closed position and vice versa. In a number of embodiments the at least one actuator 52, 54 may be formed from at least one metal or polymer including those listed above. The actuator 52, 54 may be a spring loaded connection that provides the force to move the folding table 2 from an open position to a closed position and vice versa. In particular embodiments, the actuator 52, 54 may include a slam latch. In a number of embodiments, a user may engage at least one of the plurality of handles 70, 71 which may in turn engage at least one of the plurality of actuators 52, 54 through a mechanical connection 72. The mechanical connection 72 may include a mechanical linkage by way of at least one fastener. The fastener may include nuts, bolts, bearings, battens, buckles, clips, flanges, frogs, grommets, hook-and-eyes, latches, pegs, nails, rivets, tongue-and grooves, screw anchors, snap fasteners, stitches, threaded fasteners, ties, toggle bolts, wedges anchors, screws, bolts, clamps, clasps, clips, latches, pins, rivets, ties, nails, or may be another type. In a particular embodiment, the mechanical connection 72 may include a cable or rod 73, 75 connected with fasteners to at least one of the handles 70, 71 and at least one of the actuators 52, 54. In this way, once the user engages the handle, the mechanical connection 72 may trigger the actuator 52, 54 to provide a force that folds the table from an open position to a closed position and vice versa. This is facilitated as the force provided by the at least one actuator 52, 54 operatively engages the coupling component 80 and at least one of the plurality of bar linkage connections 61, 63, 65, 67 that in turn engages the plurality of bar linkages 60, 62, 64, 66, allowing the table to fold from an open position to a closed position or alternatively from a closed position to an open position. In this way, the at least one handle 70, 71 actuates the folding table 2 through an actuator 52, 54 having an operative connection to the plurality of bar linkages 60, 62, 64, 66. In a particular embodiment, the first handle 70 would actuate the first panel half 12 while the second handle 71 would actuate the second panel half 14. In another embodiment, either of the handles 70, 71 could actuate both panel halves 12, 14 to move the table from an open position to a closed position or vice versa.

A method is known according to a number of embodiments described herein. The method may include, providing a folding table 2 including: a plurality of panel halves 12, 14, a plurality of table leg portions 22, 24, and an actuating system 50 including: a plurality of bar linkages 60, 62, 64, 66, each bar linkage 60, 62, 64, 66 operably coupling a table leg portion 22, 24 of the plurality of table leg portions 22, 24 to a corresponding panel half 12, 14 of the plurality of panel halves 12, 14, and at least one handle 70, 71. The method may further include actuating the handle 70, 71 to actuate the bar linkages 60, 62, 64, 66 to move the folding table 2 from an open position to a closed position by folding the plurality of panel haves 12, 14 inwards and downwards toward each other to form the closed position.

Figure 7:
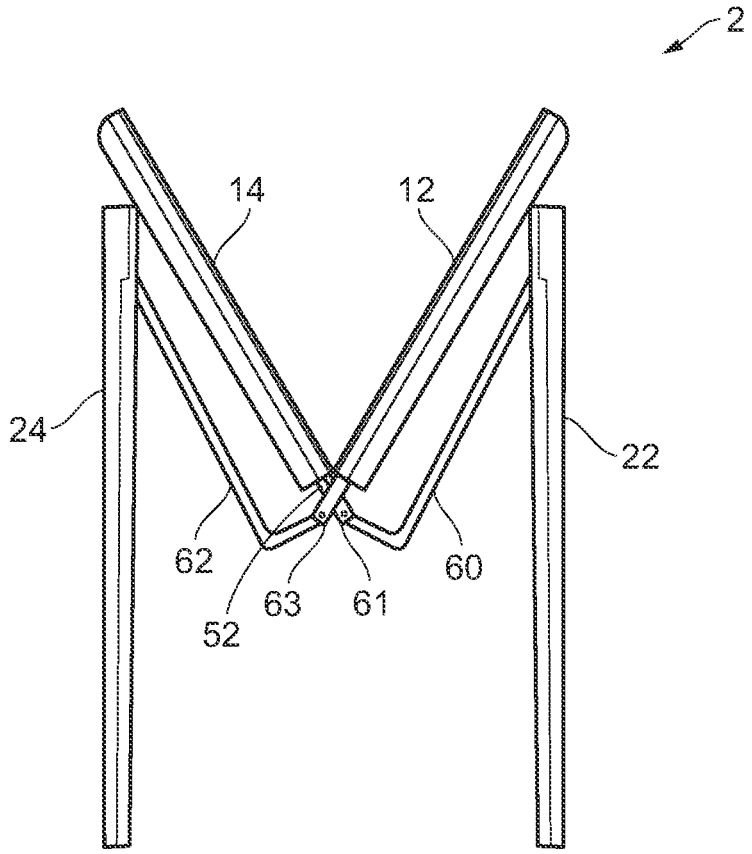
FIG. 7 is a side view of a number of embodiments of a folding table in transition between an open position and a closed position and constructed in accordance with the invention.
Figure 8:
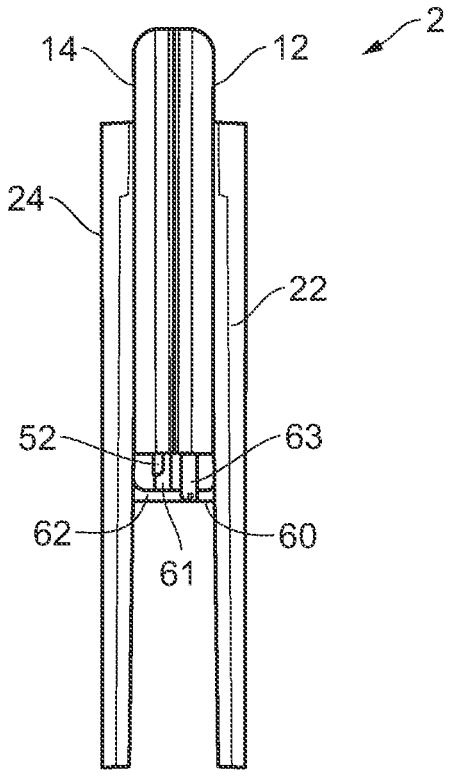
FIG. 8 is a side view of a number of embodiments of a folding table in a closed position and constructed in accordance with the invention.
Figure 9:
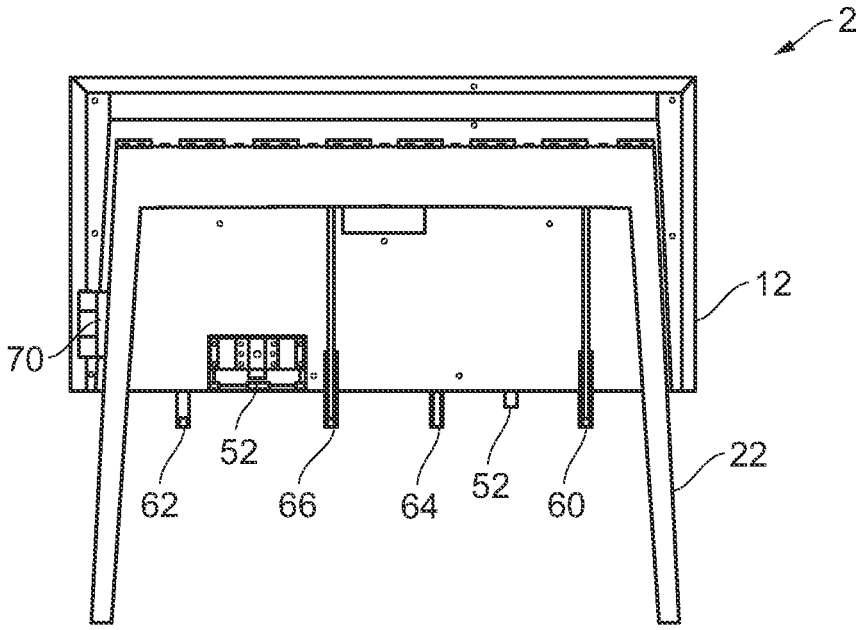
FIG. 9 is an end view of a number of embodiments of a folding table in a closed position and constructed in accordance with the invention.
Figure 10:
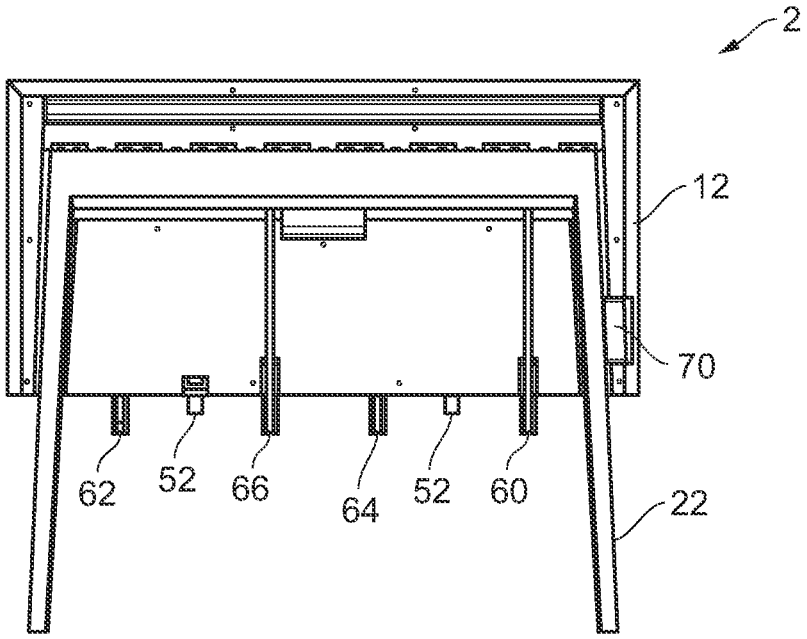
FIG. 10 is an end view of a number of embodiments of a folding table in a closed position and constructed in accordance with the invention.

FIGS. 7-10 depict views of a folding table of a number of embodiments as it moves from an open to a closed position according to the method described herein. FIG. 7 is a side view of a number of embodiments of a folding table in transition between an open position and a closed position and constructed in accordance with the invention. FIG. 8 is a side view of a number of embodiments of a folding table in a closed position and constructed in accordance with the invention. FIG. 9 is an end view of a number of embodiments of a folding table in a closed position and constructed in accordance with the invention. FIG. 10 is an end view of a number of embodiments of a folding table in a closed position and constructed in accordance with the invention. As shown in FIGS. 7-10, once at least one handle 70, 71 is engaged, the combination of the plurality of bar linkage connections 61, 63, 65, 67 and the plurality of bar linkages 60, 62, 64, 66 work together to fold the plurality of panel halves 12, 14 together so they fold inwards and downwards toward each other to form the closed position. As shown in FIG. 7, the plurality of bar linkage connections 61, 63, 65, 67 and the plurality of bar linkages 60, 62, 64, 66 work together to fold the plurality of panel halves 12, 14 downward and inward as the table leg portions 22, 24 move closer together. As shown in FIGS. 8-10, the folding table 2 is now in a closed position where the plurality of panel halves 12, 14 are now contacting one another along a portion of their length, and the plurality of table leg portions 22, 24 are folded inwards toward each other and contact the a corresponding panel half 12, 14 along a portion of their length.

In an embodiment, the folding table 2 can be actuated from an open position to a closed position or vice versa by an assembly force of at least 1 kgf in a longitudinal direction relative to the shaft 4 or housing 8, such as at least 2 kgf, at least 3 kgf, at least 4 kgf, at least 5 kgf, at least 10 kgf, or even at least 15 kgf. In a further embodiment, the folding table 2 can be installed or assembled by an assembly force of no greater than 20 kgf in a longitudinal direction to the housing 8, such as no greater than 19 kgf, no greater than 18 kgf, no greater than 17 kgf, or even no greater than 16 kgf.

The folding table of the embodiments herein can demonstrate improved operations and characteristics over conventional folding tables. For example, in one embodiment, the folding table of embodiments herein demonstrate ease of use in a light-weight folding table. Further, in one embodiment, the folding table of embodiments herein demonstrate ease of carrying over existing folding tables. Further, in one embodiment, the folding table of embodiments herein demonstrate ease of moving the table from a closed position to an open position or vice versa over existing folding tables.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the embodiments as listed below.

Embodiment 1: A folding table comprising: a plurality of panel halves that forms a support surface in an open position; a plurality of table leg portions; and an actuating system comprising: a plurality of bar linkages, each bar linkage operably coupling a table leg portion of the plurality of table leg portions to a corresponding panel half of the plurality of panel halves, at least one handle adapted to actuate the plurality of bar linkages to move the folding table from the open position to a closed position, wherein the plurality of panel halves fold inwards and downwards toward each other to form the closed position.

Embodiment 2: An method comprising: providing a folding table comprising: a plurality of panel halves, a plurality of table leg portions, and an actuating system comprising: a plurality of bar linkages, each bar linkage operably coupling a table leg portion of the plurality of table leg portions to a corresponding panel half of the plurality of panel halves, and at least one handle; actuating the handle to actuate the bar linkages to move the folding table from an open position to a closed position by folding the plurality of panel haves inwards and downwards toward each other to form the closed position.

Embodiment 3: The folding table or method according to any one of the preceding embodiments, wherein each table leg portion comprises a first leg, a second leg, and an intermediate portion coupling the first leg to the second leg.

Embodiment 4: The folding table or method according to any one of the preceding embodiments, wherein the handle actuates the folding table through an actuator having an operative connection to the plurality of bar linkages.

Embodiment 5: The folding table or method according to embodiment 4, wherein the actuator comprises a spring loaded connection.

Embodiment 6: The folding table or method according to embodiment 4, wherein the actuator comprises a slam latch.

Embodiment 7: The folding table or method according to embodiment 6, wherein the actuating system comprises a cable connecting the slam latch to the handle.

Embodiment 8: The folding table or method according to any one of the preceding embodiments, wherein the move from the open position to the closed position further comprises folding the plurality of table leg portions inwards toward each other to form the closed position.

Embodiment 9: The folding table or method according to any one of the preceding embodiments, wherein at least one of the panel halves comprises a polymer.

Embodiment 10: The folding table or method according to any one of the preceding embodiments, wherein at least one of the table leg portions comprises a polymer.

Embodiment 11: The folding table or method according to any one of the preceding embodiments, wherein the handle comprises a polymer.

Embodiment 12: The folding table or method according to embodiment 4, wherein the mechanical connection comprises a metal.

Embodiment 13: The folding table or method according to any one of the preceding embodiments, further comprising an axle rod coupling the plurality of panel halves together.

Embodiment 14: The folding table or method according to any one of the preceding embodiments, further comprising a hinged connection coupling the plurality of panel halves together.

Embodiment 15: The folding table or method according to embodiment 14, wherein the hinge connection comprises a plurality of Butler hinges.

Embodiment 16: The folding table or method according to any one of the preceding embodiments, wherein the at least one handle comprises a plurality of handles.

Embodiment 17: The folding table or method according to embodiment 16, wherein the plurality of handles each actuate the folding table through an operative connection to the plurality of bar linkages.

Embodiment 18: The folding table or method according to any one of the preceding embodiments, wherein the table has a length of between 12 in. and 150 in. in an open position.

Embodiment 19: The folding table or method according to any one of the preceding embodiments, wherein the table has a length of between 12 in. and 150 in. in a closed position.

Embodiment 20: The folding table or method according to any one of the preceding embodiments, wherein the table has a width of between 12 in. and 150 in. in an open position.

Embodiment 21: The folding table or method according to any one of the preceding embodiments, wherein the table has a width of between 12 in. and 150 in. in a closed position.

Embodiment 22: The folding table or method according to any one of the preceding embodiments, wherein the table has a height of between 12 in. and 108 in. in a closed position.

Embodiment 23: The folding table or method according to any one of the preceding embodiments, wherein the at least one handle is located on a longitudinal side of at least one of the panel halves.

Embodiment 24: The folding table or method according to any one of the preceding embodiments, wherein the folding table has a weight in the range of between 1 lb. and 50 lbs.

Embodiment 25: The folding table or method according to any one of the preceding embodiments, wherein the bar linkages are operably coupled to the table halves and the leg portions via a mechanical connection comprising a fastener.

This written description uses examples, including the best mode, and also to enable those of ordinary skill in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While embodiments have been shown or described in only some of forms, it should be apparent to those skilled in the art that they are not so limited, but are susceptible to various changes without departing from the scope of the invention.

Note that not all of the features described above are required, that a region of a specific feature may not be required, and that one or more features may be provided in addition to those described. Still further, the order in which features are described is not necessarily the order in which the features are installed.

Certain features are, for clarity, described herein in the context of separate embodiments, may also be provided in combination in a single embodiment. Conversely, various features that are, for brevity, described in the context of a single embodiment, may also be provided separately or in any subcombinations.

Benefits, other advantages, and solutions to problems have been described above with regard to specific embodiments, however, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of assembly and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or any change may be made without departing from the scope of the disclosure. Accordingly, the disclosure is to be regarded as illustrative rather than restrictive.

What is claimed is:

1. A folding table comprising:

a plurality of panel halves that forms a support surface in an open position;

a plurality of table leg portions; and an actuating system comprising:

a plurality of bar linkages, each bar linkage operably coupling a table leg portion of the plurality of table leg portions to a corresponding panel half of the plurality of panel halves, at least one handle adapted to actuate the plurality of bar linkages to move the folding table from the open position to a closed position, wherein the plurality of panel halves fold inwards and downwards toward each other to form the closed position, wherein the at least one handle is located on a longitudinal side of at least one of the panel halves.

2. The folding table of claim 1, wherein each table leg portion comprises a first leg, a second leg, and an intermediate portion coupling the first leg to the second leg.

3. The folding table of claim 1, wherein the handle actuates the folding table through an actuator having an operative connection to the plurality of bar linkages.

4. The folding table of claim 3, wherein the actuator comprises a spring loaded connection.

5. The folding table of claim 3, wherein the actuator comprises a slam latch.

6. The folding table of claim 5, wherein the actuating system comprises a cable connecting the slam latch to the handle.

7. The folding table of claim 3, wherein the mechanical connection comprises a metal.

8. The folding table of claim 1, wherein the move from the open position to the closed position further comprises folding the plurality of table leg portions inwards toward each other to form the closed position.

9. The folding table of claim 1, wherein at least one of the panel halves comprises a polymer.

10. The folding table of claim 1, wherein at least one of the table leg portions comprises a polymer.

11. The folding table of claim 1, wherein the handle comprises a polymer.

12. The folding table of claim 1, further comprising an axle rod coupling the plurality of panel halves together.

13. The folding table of claim 1, further comprising a hinged connection coupling the plurality of panel halves together.

14. The folding table of claim 13, wherein the hinge connection comprises a plurality of Butler hinges.

15. The folding table of claim 1, wherein the at least one handle comprises a plurality of handles.

16. The folding table of claim 15, wherein the plurality of handles each actuate the folding table through an operative connection to the plurality of bar linkages.

17. The folding table of claim 1, wherein the folding table has a weight in the range of between 1 lb. and 50 lbs.

18. The folding table of claim 1, wherein the bar linkages are operably coupled to the table halves and the leg portions via a mechanical connection comprising a fastener.

19. An method comprising:

providing a folding table comprising: a plurality of panel halves, a plurality of table leg portions, and an actuating system comprising: a plurality of bar linkages, each bar linkage operably coupling a table leg portion of the plurality of table leg portions to a corresponding panel half of the plurality of panel halves, and at least one handle;

actuating the handle to actuate the bar linkages to move the folding table from an open position to a closed position by folding the plurality of panel haves inwards and downwards toward each other to form the closed position, wherein the at least one handle is located on a longitudinal side of at least one of the panel halves.

* * * * *